US012575615B2

(12) United States Patent
Solano et al.

(10) Patent No.: US 12,575,615 B2
(45) **Date of Patent: *Mar. 17, 2026**

(54) WOMAN'S BODY SHAPER UNDERGARMENT FOR GENTLE SUPPORT AND SHAPE ENHANCEMENT

(71) Applicant: Maddox Holdings, Inc., Oakland Park, FL (US)

(72) Inventors: Yajaira Solano, Fort Lauderdale, FL (US); Bruce Moncada, Fort Lauderdale, FL (US)

(73) Assignee: Maddox Holdings, Inc., Fort Lauderdale, FL (US)

( * ) Notice: Subject to any disclaimer, the term of this patent is extended or adjusted under 35 U.S.C. 154(b) by 458 days.

This patent is subject to a terminal disclaimer.

(21) Appl. No.: 17/944,519

(22) Filed: Sep. 14, 2022

(65) Prior Publication Data

US 2023/0000178 A1 Jan. 5, 2023

Related U.S. Application Data

(60) Continuation of application No. 16/879,746, filed on May 20, 2020, now Pat. No. 11,857,011, and a continuation of application No. 16/876,747, filed on May 18, 2020, now Pat. No. 11,871,800, and a division of application No. 16/724,000, filed on Dec. 20, 2019, now Pat. No. 11,457,671.

(51) Int. Cl.

| | |
|---|---|
| ***A41C 1/02*** | (2006.01) |
| ***A41C 1/10*** | (2006.01) |
| ***A41D 1/21*** | (2018.01) |

(52) U.S. Cl.
CPC ..... *A41C 1/02* (2013.01); *A41C 1/10* (2013.01); *A41D 1/21* (2018.01); *A41B 2400/38* (2013.01); *A41D 2400/38* (2013.01)

(58) Field of Classification Search
None
See application file for complete search history.

(56) References Cited

U.S. PATENT DOCUMENTS

| | | | | |
|---|---|---|---|---|
| 3,413,824 | A * | 12/1968 | Kuney | D04B 15/665 66/170 |
| 7,260,961 | B1 * | 8/2007 | Kennedy | D04B 1/243 66/171 |
| 11,457,671 | B2 * | 10/2022 | Solano | A41C 1/10 |
| 11,871,800 | B2 * | 1/2024 | Solano | A41B 11/003 |

(Continued)

*Primary Examiner* — Jocelyn Bravo
(74) *Attorney, Agent, or Firm* — Alfred M. Walker

(57) ABSTRACT

A maternity under garment specifically for use during pregnancy supports the weight of a developing fetus while not encroaching on the growth aspect. The maternity undergarment has a shape that helps keep the abdomen of the pregnant woman in place, which expands as the fetus grows therein. The abdomen area features three different thicknesses on the full abdomen area. The bottom part of abdomen is a thick supportive fabric so it can hold the abdomen with the fetus therein. The section supporting the mid abdomen is lighter and less dense than that of the lower abdomen portion, because that will allow the woman's expanding abdomen to come out as the fetus grows, The top hemispheric part of the abdomen area has a thinner mesh material, that will allow the abdomen to fully come outward and upward, with no compression.

7 Claims, 9 Drawing Sheets

(56) References Cited

U.S. PATENT DOCUMENTS

| | | | | |
|---|---|---|---|---|
| 2004/0006811 | A1* | 1/2004 | McKenzie | D04B 1/243 2/240 |
| 2004/0111781 | A1* | 6/2004 | Miyake | D04B 21/207 2/69 |
| 2009/0270012 | A1* | 10/2009 | Melarti | A41C 3/08 450/11 |
| 2014/0273734 | A1* | 9/2014 | Gordon | A41C 1/06 450/7 |
| 2016/0150832 | A1* | 6/2016 | Solano | A41B 11/14 450/95 |
| 2017/0099884 | A1* | 4/2017 | Martinet | A41C 3/10 |
| 2017/0318864 | A1* | 11/2017 | Carroll | A41B 9/04 |

* cited by examiner

WOMAN'S BODY SHAPER UNDERGARMENT FOR GENTLE SUPPORT AND SHAPE ENHANCEMENT

RELATED APPLICATIONS

This application is a divisional of application Ser. No. 16/724,000 filed Dec. 20, 2019, which '000 application was allowed on Aug. 3, 2022. Applicant claims priority pursuant to 35 U.S.C. § 120 from the '000 application, which '000 application is incorporated by reference herein.

FIELD OF THE INVENTION

The present invention relates to body shaping undergarments, particularly for pregnant women, as well as improvements for variable density mesh portions of butt enhancing undergarments in general.

BACKGROUND OF THE INVENTION

The conventional types of hosiery/undergarment typically compress and smooth body portions being designed to create a toned look to the legs and some support to areas controlled by panty hose and girdles. Some prior art of this type includes U.S. Pat. No. 6,463,765 of Blakely, U.S. Pat. No. 4,267,607 of Tino, U.S. Pat. No. 5,097,537 of Ewing, U.S. Pat. No. 5,787,732 of Duran, and U.S. Published Pat. Application No. 2004/0006811 of McKenzie.

In contrast to the prior art cited above, prior art U.S. Pat. No. 10,058,131 of Solano and Moncada, assigned to Maddox Holdings Inc, relates to a butt enhancing hosiery/shaper undergarment which uses a combination of members of different materials to actually lift and shape the rear buttocks region. The buttocks area of the undergarment is surrounded on the top, sides and bottom of the buttocks area by thicker fabric material than the buttocks regions which are covered in an expandable material or mesh. Thus the left and right buttocks are supported by the thicker material on top, bottom, and left and right flanks of thicker fabric material, separated by a thin G-string area, and each buttocks area is allowed to expand into the buttocks pouch area of the mesh thereby forming a more desirable look. The front of the undergarment has a thicker fabric on the stomach wall portion to compress the stomach area. Clearly, such an undergarment is of no use during a pregnancy in mid to late term.

A maternity undergarment must primarily do no harm to a developing fetus in addition to being comfortable to wear and providing some visual enhancement. Such an undergarment should help to support the weight of a developing fetus while not imposing undue pressure on the fetus even in late term. For pregnancies involving an incontinent cervix, more extreme measures than can be addressed by an undergarment are required. U.S. Pat. Nos. 8,550,088 and 10,463,530, both of Booher, Sr., describe cervical stabilization devices and methods.

OBJECTS OF THE INVENTION

It is therefore an object of the present invention to provide a maternity undergarment which protects a developing fetus and which is comfortable to wear and which provides some visual enhancement.

It is also an object of the invention to provide a maternity undergarment which supports the weight of a developing fetus while not imposing undue pressure on the fetus even in late term.

It is further object of the present invention to provide maternity body shaping undergarment without seams.

It is yet another object of the present invention to provide variable density mesh portions of butt enhancing undergarments in general.

Other objects which become apparent from the following description of the present invention.

SUMMARY OF THE INVENTION

Using materials and methods similar to those used by the inventor in U.S. Pat. No. 10,058,131 for a butt enhancing hosiery/shaper undergarment, an under garment specifically for use during pregnancy is developed. It is an object of this invention to help support the weight of a developing fetus while not encroaching on the growth aspect. It is also an object of the invention to provide an undergarment that is comfortable to wear and improves the appearance.

The maternity undergarment that will help keep the body of the pregnant woman in place, including the abdomen which expands as the fetus grows therein. The abdomen area features three different thicknesses on the full abdomen area. The bottom part of abdomen is a thick supportive fabric so it can hold the abdomen with the fetus therein. The section supporting the mid abdomen is lighter and less dense than that of the lower abdomen portion, because that will allow the "baby bump" of the woman's expanding abdomen to come out as the fetus grows, The top hemispheric part of the abdomen area has a thinner mesh material, that will allow the "baby bump" to fully come outward and upward, with no compression. This mesh material is similar to the mesh material supporting the buttocks regions of Applicant's U.S. Pat. No. 10,058,131.

While maternity garment embodiments covering only the abdomen and crotch areas can be provided, in a preferred embodiment, the garment preferably features a full back with bra straps the go over the shoulder of the pregnant woman.

The seamless undergarment may be manufactured in a conventional manner with conventional knitted materials, such as, for example, NYLON®, LYCRA®, SPANDEX®, silk, cotton, or cellulose derived fabric materials, such as RAYON®, etc. It is preferably manufactured on a circular hosiery knitting machine using a Jacquard machine, or by warped knitted seamless technique or other seamless knitting process. Rather than using elastic bands, knitted-in welts are knitted in during the knitting process where needed. This enables the garment to be manufactured in one continuous knitting process thereby eliminating a further post-process of attaching elastic bands. Preferably using tubular forms, the warped knitting seamless technique creates body forming garments from the original tubular structures, which are anatomically adaptable in shape, but also can add various arm and leg sub-features to the anatomically shaped tubular garment.

As mentioned in the previous section, the undergarment of Applicant's U.S. Pat. No. 10,058,131 for a butt enhancing undergarment uses expandable mesh regions to cover the rear buttocks regions and a thicker fabric to cover the stomach wall area to flatten the stomach area. For this invention, the stomach wall area is partly covered in an expandable mesh similar to that used on the buttocks area of the previous invention. In this manner, as the pregnancy progresses and the fetus grows, the area readily expands to accommodate. The butt enhancement features of the previous invention can remain in the maternity garment.

The maternity garment preferably one or more supportive abdominal areas, wherein the thickest supportive fabric in in the lower abdominal portion of said full abdomen area, and is provided in a thickness of a range of deniers of from about 40 deniers to about 200 deniers, Expressed another way, the lowest abdominal portion, like side flanks of the garment, has a weight of about 230 to 420 GSM (grams per square meter of fabric material). In this situation, the flank and lower support regions of the abdominal area of the garment made be made of stretchable materials, such as, for example, NYLON®, LYCRA®, SPANDEX®, silk, cotton, or cellulose derived fabric materials, such as RAYON®, etc. Preferably, however, this flank and lower support abdominal area is made of 90% NYLON and 10% LYCRA if provided in a single color, or if multicolored pattern designs are provided, may be made of about 84% polyester and about 16% LYCRA. Where a middle band material of the abdominal area is provided, it is made of material less dense and lighter than said lower abdomen portion and is provided in a thickness of from about 20 deniers to about 100 deniers. The expandable mesh region of the upper abdominal area is the lightest of all three portions and is provided in a range of about 10 deniers to about 50 deniers of said garment.

An extra wide-open crotch double gusset is preferably provided allowing the user to utilize the restroom without removing the maternity undergarment; this is more important for convenience in a maternity garment since the frequency of urination is usually increased. However, in alternate embodiments other closures such as zipper portion can be provided, or even not provided, where removal of the garment would be required in a rest room.

Therefore, the maternity garment includes at least a stretchable mesh region in an upper abdomen portion of a full abdomen area of the garment expandable over time of a pregnancy and adapted to accommodate a growing fetus. Side flank areas of fabric of the garment are sufficiently thick to provide side support for said stretchable mesh region, and the side flank areas extended around a back of said maternity garment. Adjustable bra straps may be optionally provided supporting said flank areas, which extend down to at least the crotch of the garment, or optionally to thigh bands of the garment. While the entire front abdominal area can be provided in a single thickness mesh material, preferably the abdominal area includes a thinnest upper portion to allow expansion during growth of the fetus during pregnancy, as well as a middle band of structural support material is attached to a bottom edge of the mesh region extending from one side flank area to an opposite side flank area providing bottom support of the upper mesh region, which optionally can cover the entire front abdominal region, or preferably in an preferred embodiment cover an upper portion of the wearer's expanding, pregnant abdomen. In this preferred embodiment a middle abdominal band is bounded by the thinner upper abdominal expandable region and above a lower abdomen portion of the full abdomen area of the garment, which is beneath the middle band. In this preferred embodiment the lower abdomen portion includes a layer of solid fabric adapted to support the weight of the growing fetus in the pregnant wearer.

An optional crotch area of the maternity garment includes structural sections of support material, with this optional crotch including a wide-open crotch double gusset allowing use of a rest room without removal of the maternity garment. In non-preferred embodiments, the closure may be a zipper, or may not be provided at all, which would require of the entire garment in the rest room.

While the mesh abdominal area can include two or more mesh regions, in the preferred embodiment the maternity garment includes a full abdomen area featuring three different thicknesses of material. The lower abdomen portion is the thickest supportive fabric in the full abdomen area, while the middle band is made of material less dense and lighter than the lower abdomen portion, and the upper abdominal mesh region is the lightest of all three portions of the full abdomen area of the garment.

Preferably the garment is seamless, made in a continuous knitting process. The garment is therefore constructed entirely of knitted materials in which the garment is manufactured in one continuous knitting process thereby eliminating a post-process of attaching elastic bands.

However, in non-preferred embodiments the various parts of the garment can be separately made and attached together to a central hollow body portion by being sewn with threads or glued with strips of glue or other adhesive.

While garment is preferably made to start below the breasts, upper chest and back portions can be provided and/or the garment has an opening for use of a bra.

Additionally, in an optional embodiment side flank areas of the garment are adapted to cover buttocks of a user. These flank areas may include stretchable mesh regions adapted to enclose said buttocks. However, preferably the buttocks enclosed mesh regions include multiple regions of stretch, such as at least one of the multiple regions being less stretchable. In a further alternate embodiment, the multiple regions include two or more less stretchable regions, preferably arcuately shaped, are provided at the lowest portion of the buttocks mesh regions.

In an alternate embodiment, the upper abdominal, mid waist and lower abdominal areas can be made off a single, integral front portion, wherein the upper abdomen portion, the middle band and the lower abdominal portion are a single, integral mesh.

Where the multiple buttocks mesh regions include three regions, a thickest mesh of the plurality of buttocks enclosed mesh regions is provided in a thickness of a range of deniers of from about 20 deniers to about 100 deniers, wherein further a second mesh of less dense and lighter mesh than the thickest mesh is provided in a thickness of from about 10 deniers to about 80 deniers, and wherein the mesh region being the lightest of all three portions is provided in a range of about 10 deniers to about 50 deniers of said garment.

In an alternate embodiment, the expandable mesh used in either the buttocks or the upper front regions has variable density or stretchability so that it is heavier (less stretch) on the bottom area to more closely approach the ideal amount of stretch for the local load. Three separate density areas of mesh are used from top to bottom of a mesh region. It is important that these regions are seam free to insure a smooth comfortable fit with "no lines". Another alternative is to have a density that is continuously variable getting heavier as the bottom of the mesh region is approached. It is noted that these variable density mesh regions can be used on non-maternity garments on the buttocks regions as well. In this embodiment for expandable mesh portions of any body shaper/undergarment, whether for a pregnant woman or not, this extra option for the buttocks area features the aforementioned three different thicknesses on buttocks pockets throughout the mesh. The reason why the three different, seamless, blended mesh buttocks' areas are provided, is because if the wearer already has large buttocks, there can be an undesirable compression line or a mark that can be visible under thigh of thin clothes. This multi-part mesh region with variable blended thicknesses solves this issue by giving the sides and bottom part of buttocks mesh more control with one or more regions of thicker mesh.

This alternate embodiment for a buttocks enclosing region having multiple regions of stretch for gentle support and shape enhancement can be used with any one piece undergarment covering at least an upper and a lower region of a front abdominal area, a rear back area and a pair of side flank regions on each side of said undergarment connecting said front abdominal to said rear back area, where the under garment further includes a rear buttocks portion. The buttocks portion is a pair of less compressive mesh regions separated by an integral G-string connection passing closely between left and right buttocks of the wearer.

The less compressive buttocks mesh regions are supported by side flank support regions adjacent to said upper and lower regions supporting the buttocks regions from the sides and below, whereby said pair of buttocks mesh regions are further pushed outward without compression. These buttocks regions are fully covered by mesh made from garment material thinner and less compressive than the respective garment material making up a remainder of said undergarment, allowing said buttocks regions to be pushed upward and outward without compression during wearing of the undergarment of the wearer.

The multiple regions of stretch, with lower portions of said at least one mush regions being less stretchable are at the lower regions of the buttocks mesh regions, to provide further support at the lower portion of the buttocks with a thicker, more supportive mesh material While the thicker, more supportive mesh region can be one or more thicker supportive portions, in a preferred embodiment there may be two additional thicker mesh regions provided as arcs covering the lowest portions of the wearer's buttocks. In that case the a thickest mesh of said plurality of meshes in the buttocks enclosed mesh regions is provided in a thickness of a range of deniers of from about 20 deniers to about 100 deniers, wherein further a second mesh of less dense and lighter mesh than said thickest mesh is provided in a thickness of from about 10 deniers to about 80 deniers, and wherein the mesh region covering the remaining portion of each of the buttocks regions being the lightest of all three portions is provided in a range of about 10 deniers to about 50 deniers of said garment.

In non-preferred garments, where the garment is not seamless, the separate parts of the undergarment can be sewn together with threads, or glued together by thin strips of glue, and are therefore also seamless, as are the knitted versions in the above noted preferred embodiments.

BRIEF DESCRIPTION OF THE DRAWINGS

The present invention can best be understood in connection with the accompanying drawings. It is noted that the invention is not limited to the precise embodiments shown in drawings, in which.

It is further noted that the various region areas of the maternity undergarment are shown with various cross hatchings and line configurations, which like areas bear the same cross hatchings and/or line configurations.

DETAILED DESCRIPTION OF THE INVENTION

Figure 1:
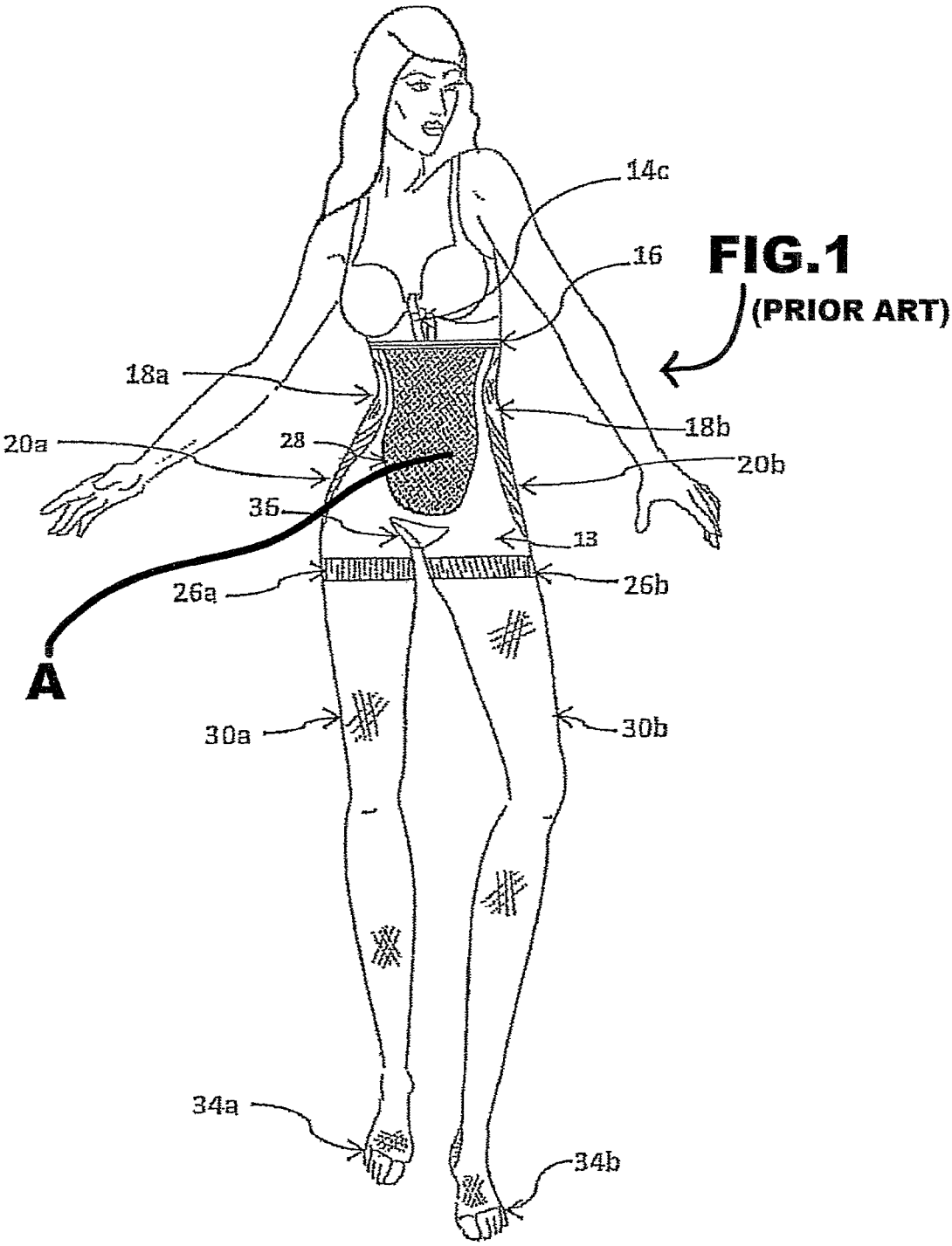
FIG.1 (PRIOR ART)
FIG. 1 illustrates a front perspective view of a non-maternity undergarment of a previous prior art invention.
Figure 2:
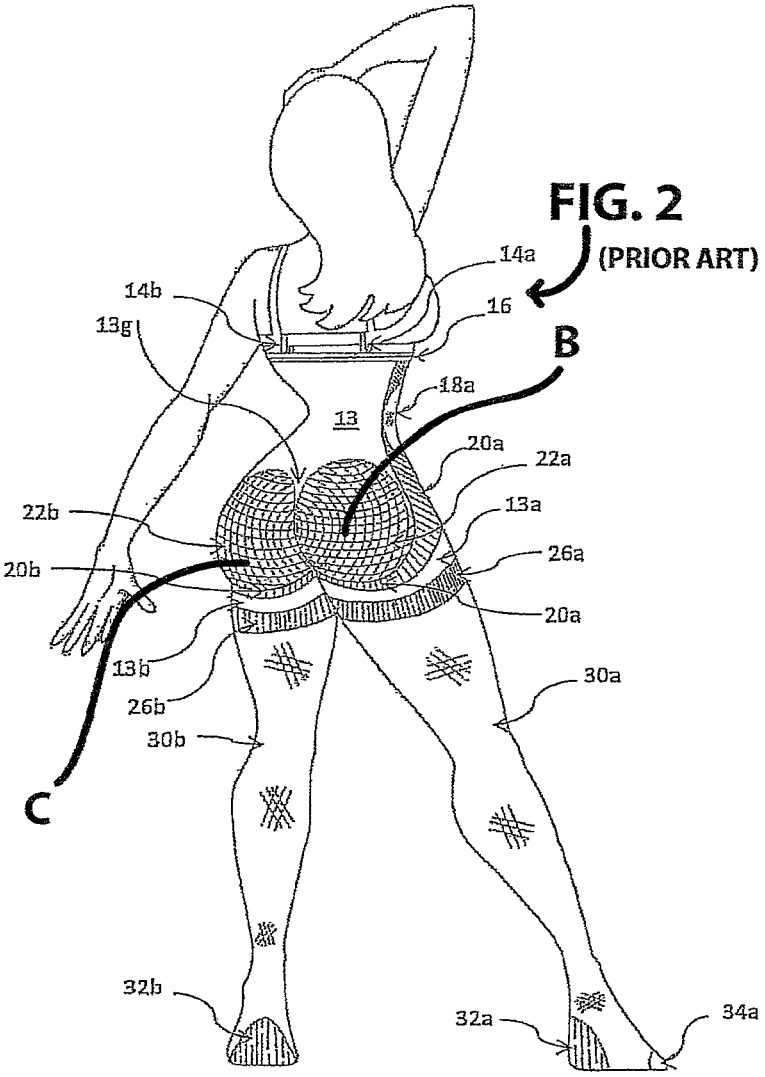
FIG. 2 (PRIOR ART)
FIG. 2 illustrates a rear perspective view of the same non-maternity undergarment of FIG. 1 from the previous prior art invention.

FIGS. 1 and 2 are prior art drawings illustrating the front and the back respectively of an undergarment for butt enhancement. In FIG. 2, mesh regions marked with item labels "B" and "C" are expandable pouches which allow the buttocks to expand into them as supported by less stretchable surrounding regions to form a more desirable look. FIG. 1 of the same prior art shows a thick fabric region over the stomach wall marked as item label "A" which helps to compress the stomach flat.

Figure 3:
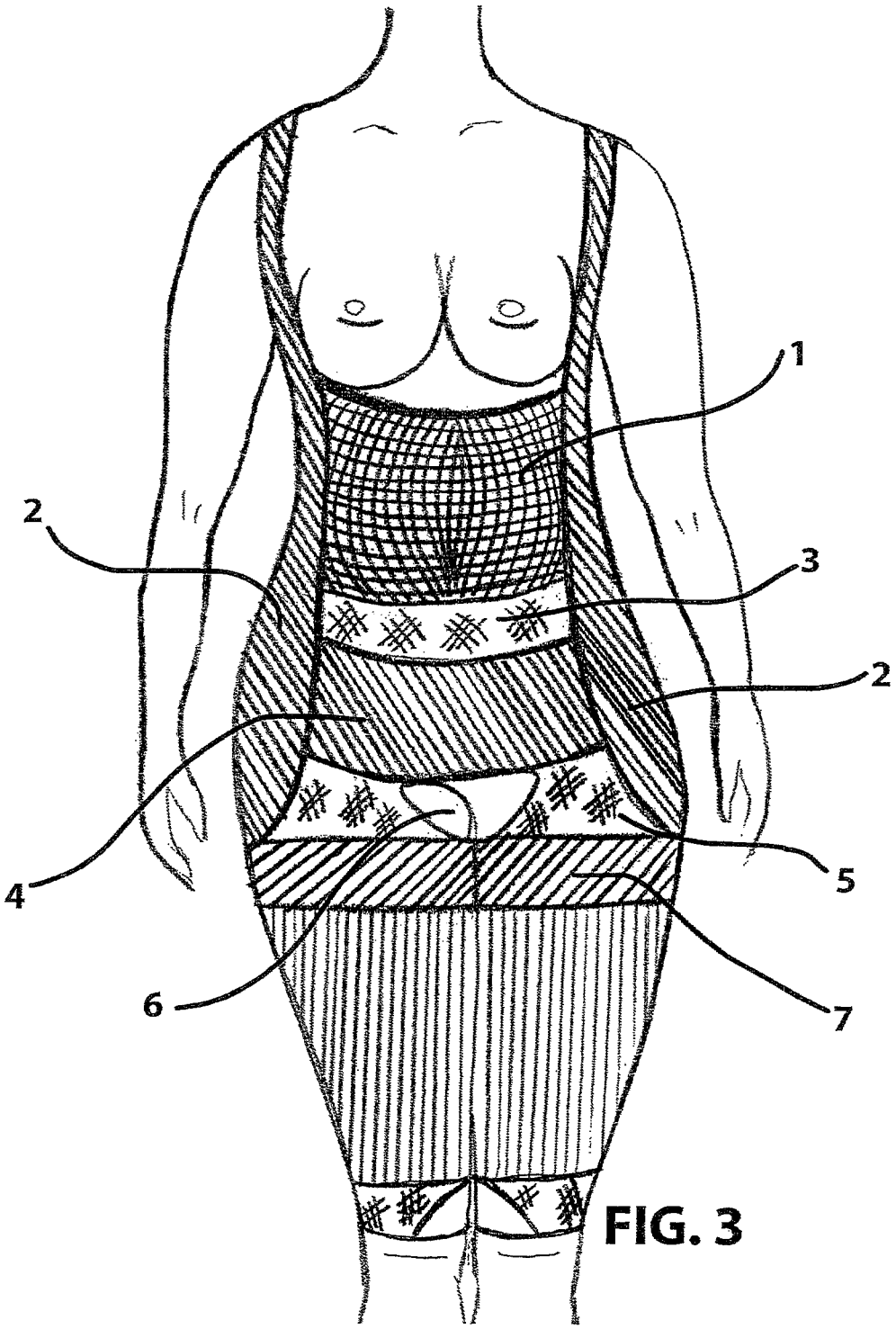
FIG. 3 illustrates a front perspective view of the maternity undergarment of the present invention.
Figure 4:
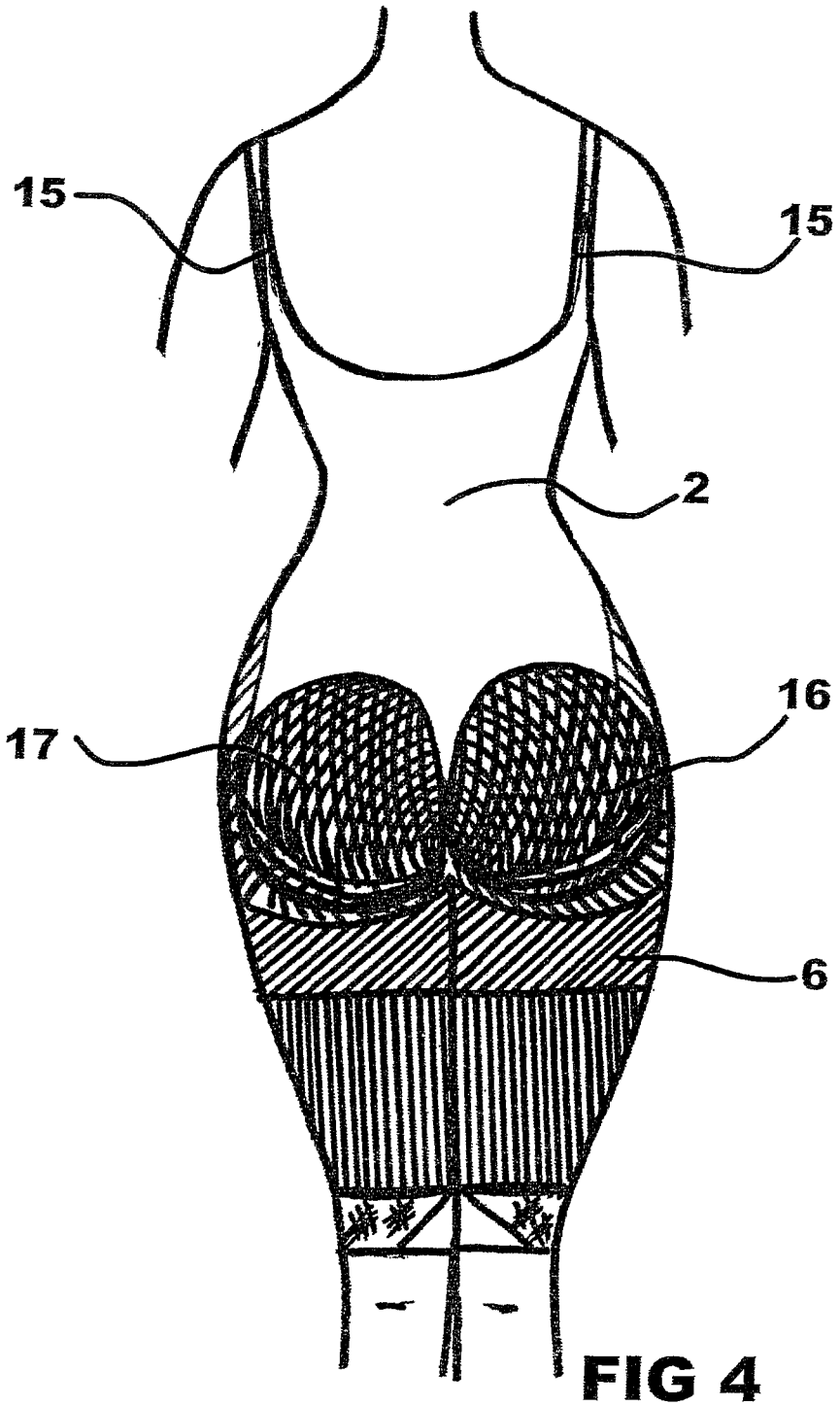
FIG. 4 illustrates a rear perspective view of the maternity undergarment of the present invention.
Figure 5:
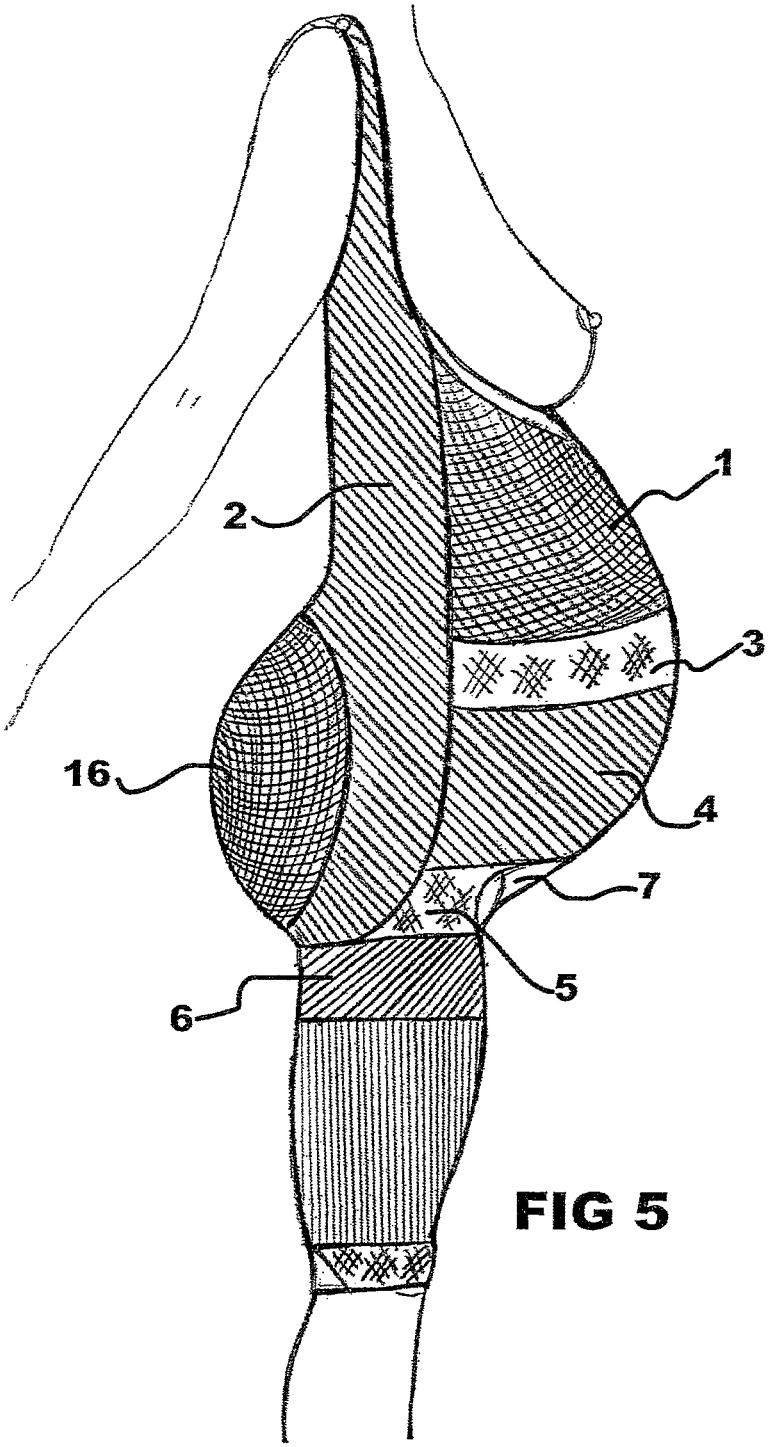
FIG. 5 illustrates a right-side perspective view of the maternity undergarment of the present invention.

FIG. 3 is a front perspective view of a maternity undergarment of this invention as worn by a user. Although specific undergarments may vary in terms of materials and design, the functional aspects are well illustrated by the elements of FIG. 3. Stretchable mesh region 1 used in the upper abdomen expands outward over the time of the pregnancy without encroaching on a growing fetus. The area around the crotch 5 as well as the middle band 3 are structural sections of thick support material. Lower abdomen section 4 is a one-layer solid fabric which supports the weight of the fetus. The side flank areas 2 are of the thickest fabric which continues to the back as illustrated in FIG. 4, the back view. Thigh bands 6 may have knitted-in welts. Item 7 is a wide-open crotch double gusset. Two bra straps with adjusters 15 support the undergarment foundation (i.e., back and side flanks). The mesh areas on right buttocks 16 and left buttocks 17 are shown as supported at the edge by fabric 2. FIG. 5 is a right-side perspective view showing the items described in FIGS. 3 and 4 from the side where sections such as the shape of the foundation 2 are more clearly visible.

Figure 6:
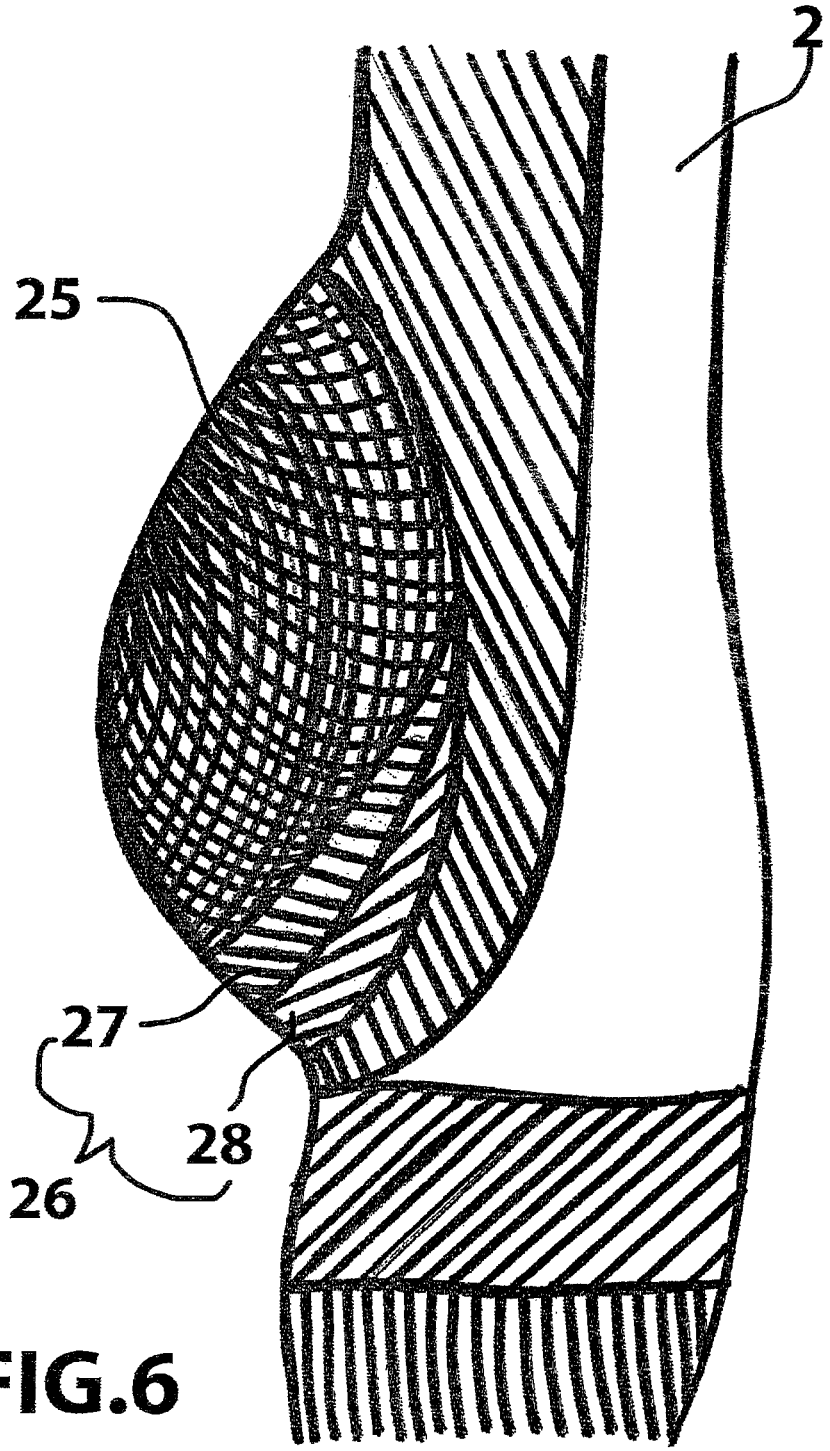
FIG. 6 is a right-side perspective detail of an alternate embodiment of the right buttocks covering in mesh illustrating the two bands of higher density mesh at the bottom area.
Figure 7:
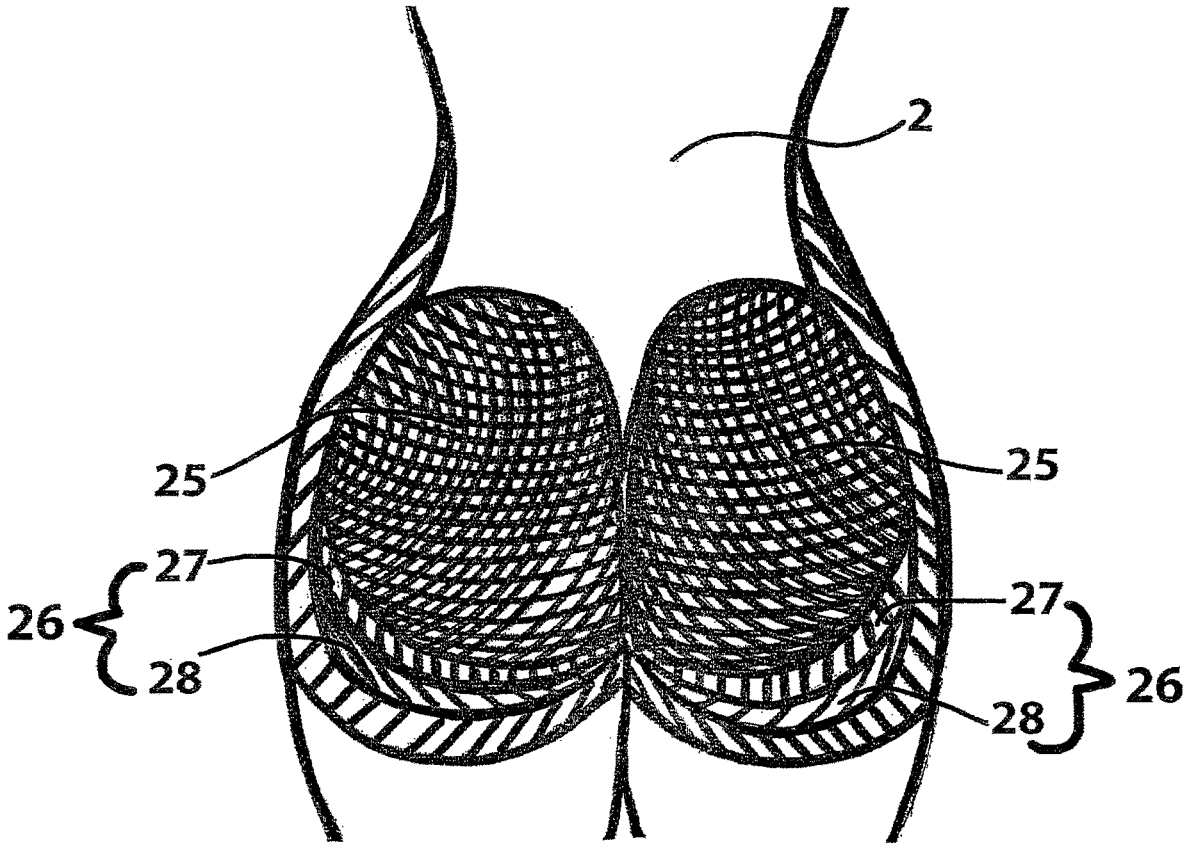
FIG. 7 is a rear perspective detail of the alternate embodiment mesh covering as in FIG. 6 showing the two higher density bands near the bottom of the mesh areas of both buttocks.
Figure 8:
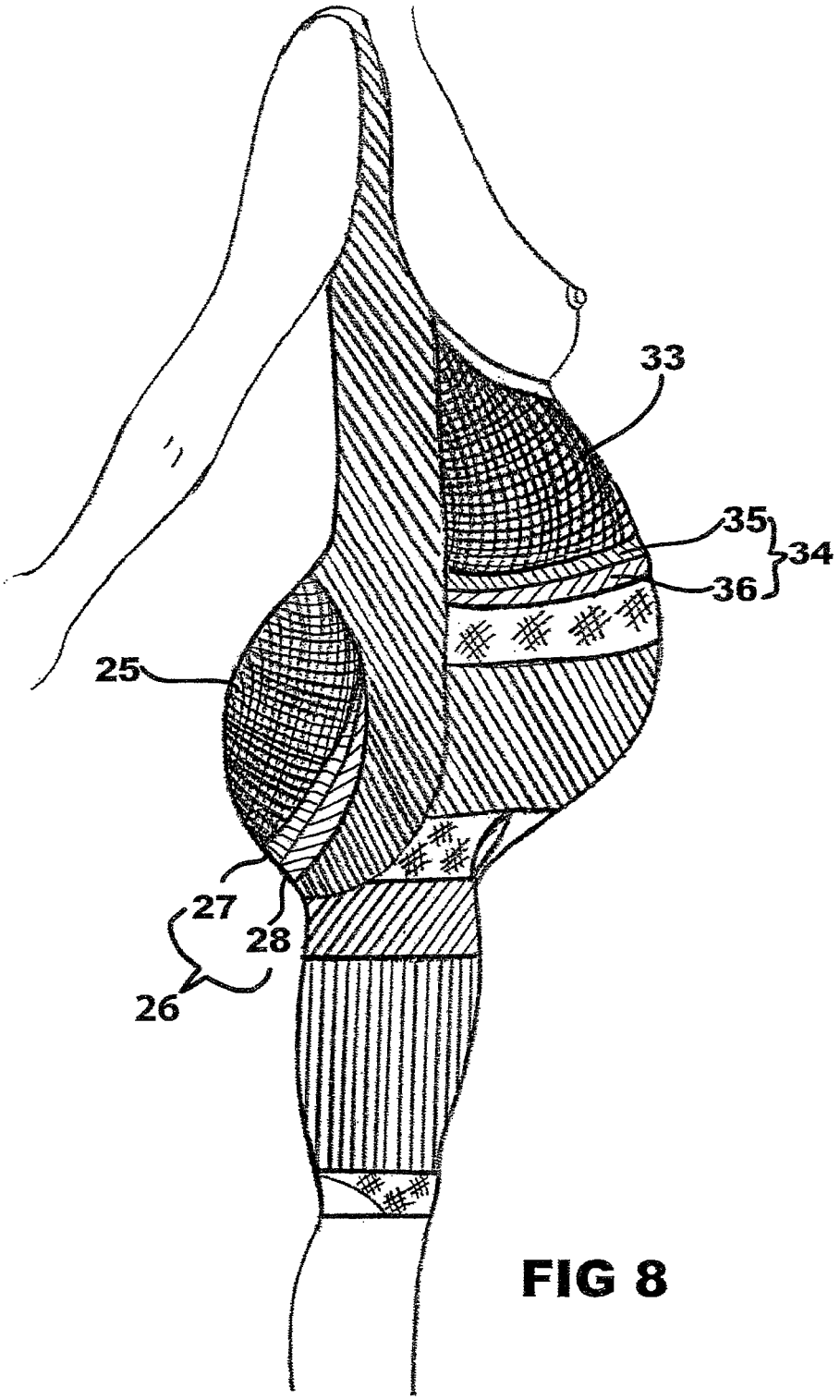
FIG. 8 is a right-side perspective view of the maternity undergarment of the present invention showing the higher density bands of both buttocks as well as the higher density mesh bands near the bottom of the front mesh region.
Figure 9:
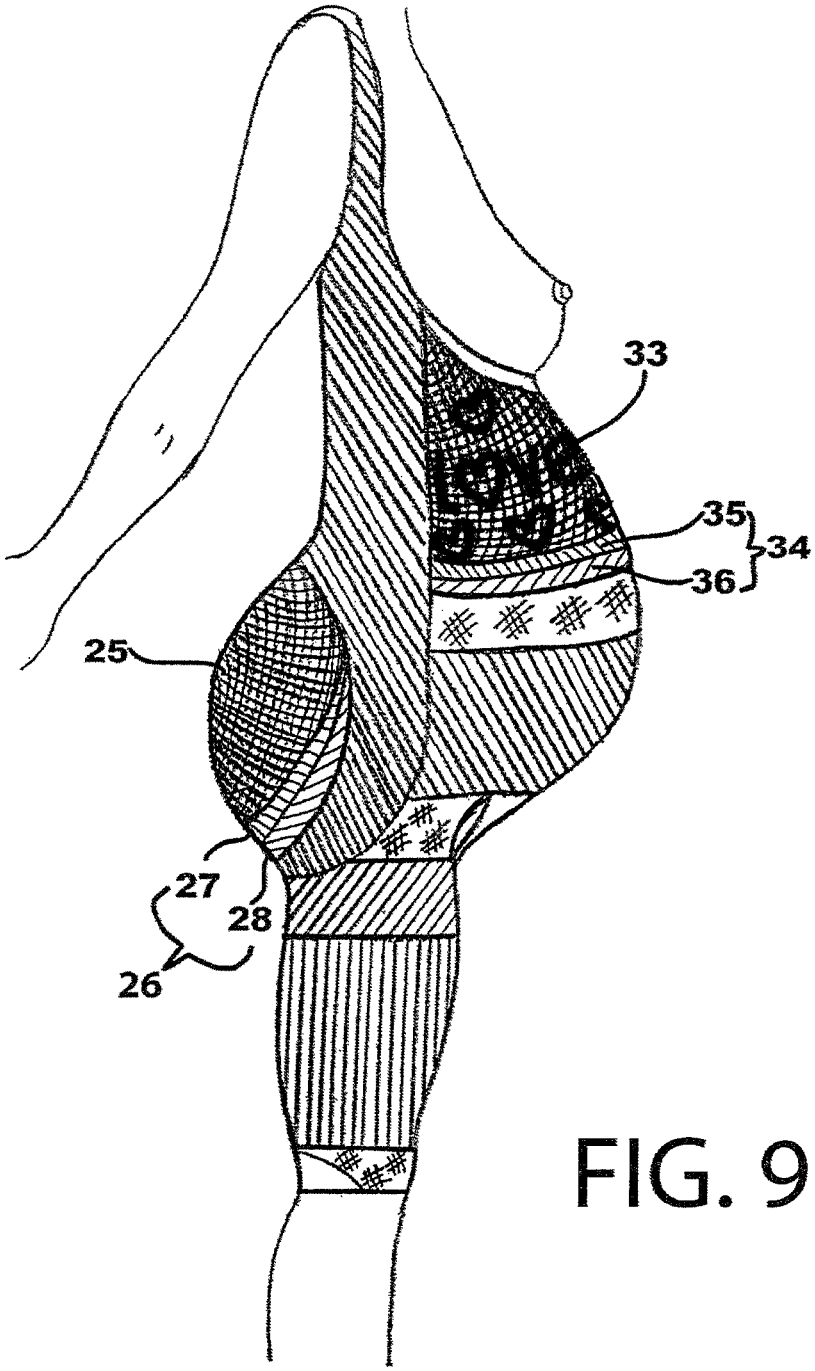
FIG. 9 is a right side perspective view of the maternity garment of FIG. 8, showing a multi-color pattern design adorned on a mesh portion of the maternity garment.

FIGS. 6-8 illustrate an alternate embodiment wherein the stretchable mesh areas have variable stretchability. FIG. 6 is a detail of a right buttocks area covered in mesh 25 that has three regions of stretch. While most of the area of 25 is thin and quite stretchable; the bottom portion 26 has two bands which become more dense and have less stretch. Band 28, adjacent to support fabric 2 is the densest mesh while band 27 is less dense than 28 but denser than the upper part of 25. FIG. 7 shows the same details from a back view of both buttocks 25. FIG. 8 illustrates a maternity undergarment of the second embodiment with three regions of stretch for both the buttocks mesh as well as the front mesh. In this side view, both rear mesh 25 as well as front mesh 33 can be seen. In front mesh 33, lower bands 35 and most dense mesh 36 are shown at the bottom edge as region 34. It is important that seamless implementation of these bands is used to eliminate outwardly visible lines. A continuously variable stretch knitting is ideally suited to replace the discrete bands shown here. FIG. 9 shows the garment of FIG. 8, but with optional multicolored pattern designs 37 provided on the front mesh 33 of the undergarment.

Since the buttocks area mesh and the front mesh are quite isolated from each other, a maternity undergarment without the buttocks mesh enhancement is feasible as is a non-maternity butt enhancing undergarment with a variable density mesh.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. An undergarment for firm support and shape enhancement, the undergarment comprising:

a one-piece seamless undergarment comprising at least an upper region, a mid waist region, and a lower region of a front abdominal area, a rear back area and a pair of side flank supports on each side of said undergarment connecting said front abdominal area to said rear back area;

said garment further having a rear buttocks portion;

said flank supports configured to not cover said rear buttocks portion;

said rear buttocks portion comprising a pair of mesh regions configured to cover only left and right buttocks of a wearer;

wherein said pair of side flank supports are located adjacent to said upper, mid waist, and lower regions, said pair of flank supports along respective left and right outer peripheral edges of said upper, mid waist and lower abdominal regions, said side flank supports supporting said rear buttocks portion from the sides and below, wherein said pair of mesh regions of said rear buttocks portion are further pushed outward without compression; and said mesh regions comprising a mesh material that is thinner than a respective garment material making up a remainder of said undergarment, allowing said mesh regions to be pushed upward and outward without compression during wearing of the undergarment;

wherein said mesh regions include multiple regions of stretch that are continuous with one another and define a continuously variable density, wherein said multiple regions of stretch comprise upper regions and lower regions, wherein said lower regions form bands that are denser and less stretchable than said upper regions.

2. The undergarment of claim 1 wherein said mesh regions of said rear buttocks portion are separated by an integral G-string connection configured to pass closely between left and right buttocks of the wearer, wherein said integral G-string connection has a tapered width that is smaller towards a bottom of said rear buttocks portion.

3. The undergarment as in claim 1 wherein said mesh regions are provided in a thickness of between 10 and 100 denier.

4. An undergarment for firm support and shape enhancement, the undergarment comprising:

a one-piece seamless undergarment comprising at least an upper region, a mid waist region, and a lower region of a front abdominal area, a rear back area and a pair of side flank supports on each side of said undergarment connecting said front abdominal area to said rear back area; said garment further having rear buttocks regions, and said undergarment adapted to extend up from an upper thigh of a wearer;

said flank supports configured to not cover said rear buttocks regions;

said rear buttocks regions comprising a pair of mesh regions adapted to cover only the buttocks of said wearer, wherein said pair of mesh regions are at least partially spaced apart from one another;

wherein said pair of side flank supports are located adjacent to said upper, mid waist, and lower regions, said pair of flank supports extending along respective left and right outer peripheral edges of said upper mid waist and lower abdominal regions, said side flank supports supporting said rear buttocks regions from the sides and below, wherein said pair of mesh regions of said rear buttocks regions are further pushed outward without compression; and said mesh regions comprising a mesh material that is thinner than a respective garment material making up a remainder of said undergarment allowing said rear buttocks regions to be pushed upward and outward without compression during wearing of the undergarment;

wherein said mesh regions include multiple regions of stretch that are continuous with one another and define a continuously variable density, wherein said multiple regions of stretch comprise upper regions and lower regions, wherein said lower regions comprise at least one lower band that is denser and less stretchable than said upper regions.

5. The undergarment as in claim 4 wherein said mesh regions are provided in a thickness of between 10 and 100 denier.

6. An undergarment for firm support and shape enhancement, the undergarment comprising:

a one-piece seamless undergarment comprising at least an upper region and a lower region of a front abdominal area, a rear back area and a pair of side flank supports on each side of said undergarment connecting said front abdominal area to said rear back area and said undergarment adapted to extend up from an upper thigh of a wearer;

said garment further having rear buttocks regions;

said flank supports configured to not cover said rear buttocks regions;

said rear buttocks regions being fully covered only by a mesh material that is thinner than a respective garment material making up a remainder of said undergarment, allowing said rear buttocks regions to be pushed upward and outward without compression during wearing of the undergarment;

wherein said mesh material includes multiple regions of stretch that are continuous with one another and define a continuously variable density, wherein said multiple regions of stretch comprise upper regions and lower regions, wherein said lower regions are denser and less stretchable than said upper regions.

7. The undergarment as in claim 6 wherein said mesh regions are provided in a thickness of between 10 and 100 denier.

* * * * *